United States Patent [19]

Reiner et al.

[11] 4,159,594

[45] Jul. 3, 1979

[54] DOLL AND SIMULATED FEEDING APPARATUS

[75] Inventors: Lawrence L. Reiner, 1 Hickory La., Woodbury, L.I., N.Y. 11797; John O'Shaughnessy, Staten Island, N.Y.

[73] Assignee: Lawrence L. Reiner, Woodbury, N.Y.

[21] Appl. No.: 852,191

[22] Filed: Nov. 17, 1977

[51] Int. Cl.[2] ..... A63H 33/26

[52] U.S. Cl. ..... 46/239; 46/141

[58] Field of Search ..... 46/141, 236, 237, 238, 46/239; 272/8 N

[56] References Cited

U.S. PATENT DOCUMENTS

| | | | |
|---|---|---|---|
| 2,519,883 | 8/1950 | Bustanoby | 46/237 |
| 2,519,884 | 8/1950 | Bustanoby | 46/237 |
| 2,531,912 | 11/1950 | Kahn | 46/151 X |
| 3,202,423 | 8/1965 | Becker | 46/239 X |

*Primary Examiner*—F. Barry Shay
*Attorney, Agent, or Firm*—Edward F. Levy

[57] ABSTRACT

A toy feeding spoon is provided for use with a baby doll having a head with a permanent magnet mounted therein adjacent the mouth portion thereof. The spoon includes a hollow bowl portion with a circular disc rotatably mounted therein and a top wall covering over and concealing a portion of said disc. A bar magnet is mounted on the under side of said disc and cooperates with the magnet in said doll head to turn said disc to a first selected position in which said spoon appears to be empty, when the spoon is brought to the doll mouth. The bar magnet on said disc also cooperates with a permanent magnet mounted within a simulated food container to turn said disc to a second selected position in which said spoon appears to be filled with food, when said spoon is lowered into the interior of said container.

7 Claims, 6 Drawing Figures

FIG. 1
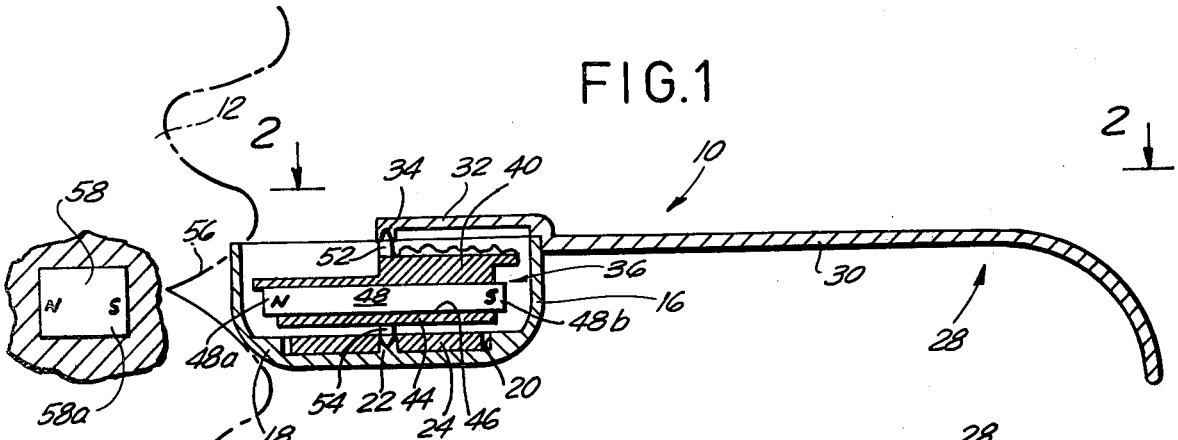
FIG. 2
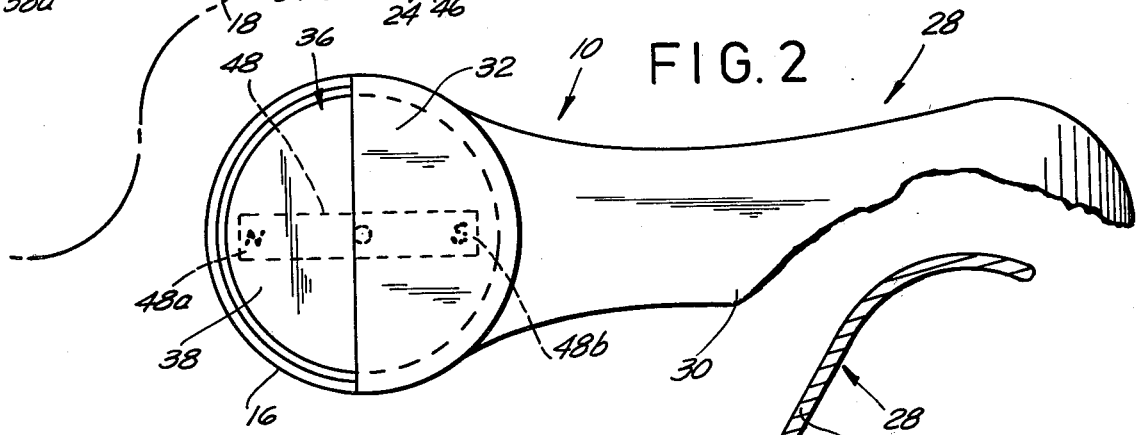
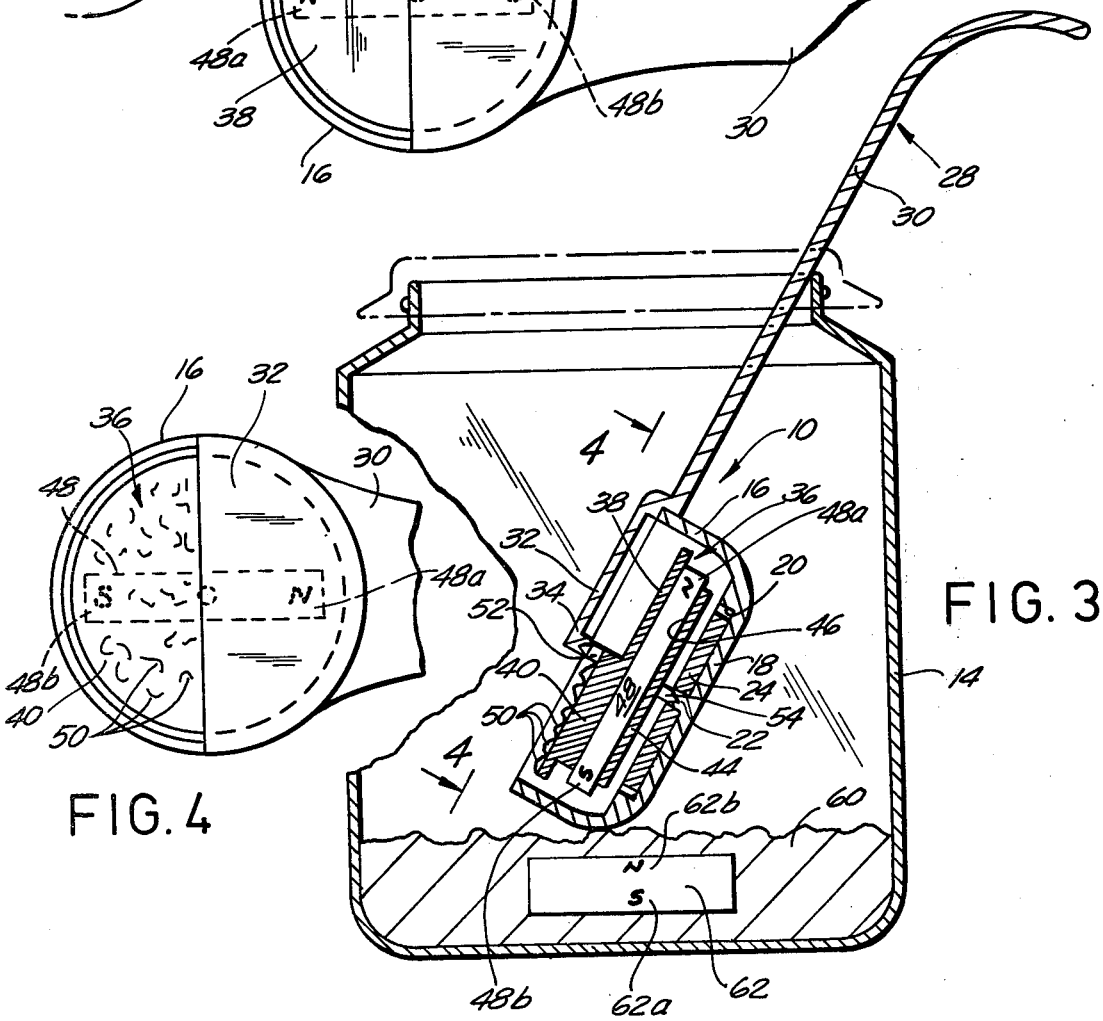
FIG. 3
FIG. 4

DOLL AND SIMULATED FEEDING APPARATUS

The present invention relates to apparatus for simulating the feeding of a baby, and in particular to a toy feeding spoon which cooperates with a magnet in the mouth of a doll and a magnet in a simulated food container to create an illusion of food begin fed from the container to the doll and eaten by the latter.

Toy dolls have previously been provided with structures for simulating the feeding of babies, by bottle feeding, spoon feeding or the like. For example, in U.S. Pat. No. 2,096,601 issued Oct. 19, 1937 and U.S. Pat. No. 3,858,352 issued Jan. 7, 1975, food is actually delivered by spoon into the mouth opening of a doll, but of course this requires frequent cleaning out of the doll interior. In U.S. Pat. No. 2,519,883 issued Aug. 22, 1950, a doll head is provided with a permanent magnet which cooperates with a magnet embedded in a simulated article of food in such a manner that the doll mouth will open when the article of food is brought into close proximity therewith. In U.S. Pat. No. 2,531,912 issued Nov. 28, 1950, a magnet embedded in the movable lower jaw of a doll is attracted to a metal spoon inserted in the doll mouth to cause the jaw to bite upon the spoon. In U.S. Pat. No. 3,394,494 issued July 30, 1968 a magnet mounted in the mouth of a movable doll head cooperates with a magnet in a spoon or nursing bottle to cause the doll head to turn toward or away from the spoon or bottle when the latter is brought close to the doll mouth.

In accordance with the present invention there is provided apparatus for simulating the feeding of food to a baby doll comprising a spoon having a bowl portion with a rotatable circular disc mounted therein. The disc is divided into two half sections, the first of which has a flat upper surface serving as a false bottom of the spoon, and the second of which is decorated to simulate food to be fed to the doll. The spoon has a cover member covering over the rear end portion of the bowl, and the disc is turnable between a first position in which the first half section thereof is exposed to view forwardly of said cover member and the second half section is concealed beneath said cover member to simulate an empty spoon, and a second position in which the second half section is exposed to view and the first half section is concealed beneath said cover member to simulate a spoon containing food.

A bar magnet is mounted on the lower surface of said disc and is arranged to cooperate with a permanent magnet secured within the head of the doll adjacent the mouth portion thereof in such a manner that when the spoon, with the disc in its second operative position is brought into proximity with the permanent magnet adjacent said doll mouth, the disc is turned to its first operative position. This creates the appearance of a spoon filled with food being brought to the mouth of the doll and brought away empty.

The bar magnet mounted on said disc is also adapted to cooperate with a permanent magnet affixed within a container simulating a container of food, in such a manner that when said spoon, with the disc in its first operative position, is inserted into said container and brought into proximity with the permanent magnet therein, the disc is turned to its second operative position. This creates the appearance of an empty spoon being inserted into said container and withdrawn therefrom filled with food.

An object of the present invention is to provide apparatus of the character described which operates in a simple and effective manner by magnetic means to create the illusion of an empty spoon being filled with food from a container of food, and then being emptied of said food in the mouth of the doll, to simulate the feeding of a baby in a natural manner.

Another object of the invention is the provision of apparatus of the character described containing a few simple parts, which is economical in manufacture, yet highly effective in simulating the feeding of a baby.

Additional objects and advantages of the invention will become apparent during the course of the following specification when taken in connection with the accompanying drawings in which:

FIG. 1 is a central longitudinal section through a feeding spoon made in accordance with the present invention and shown in a first operative position proximate to the mouth of a doll head having a magnet therein;

FIG. 2 is a top plan view of the spoon shown in its first operative position, as viewed from line 2—2 of FIG. 1;

FIG. 3 is a central longitudinal section through the spoon, showing the same inserted within a simulated container of food containing a permanent magnet, with the spoon shown in a second operative position;

FIG. 4 is a partial top plan view of the spoon in its second operative position, as viewed from line 4—4 of FIG. 3;

Figures 5, 6:
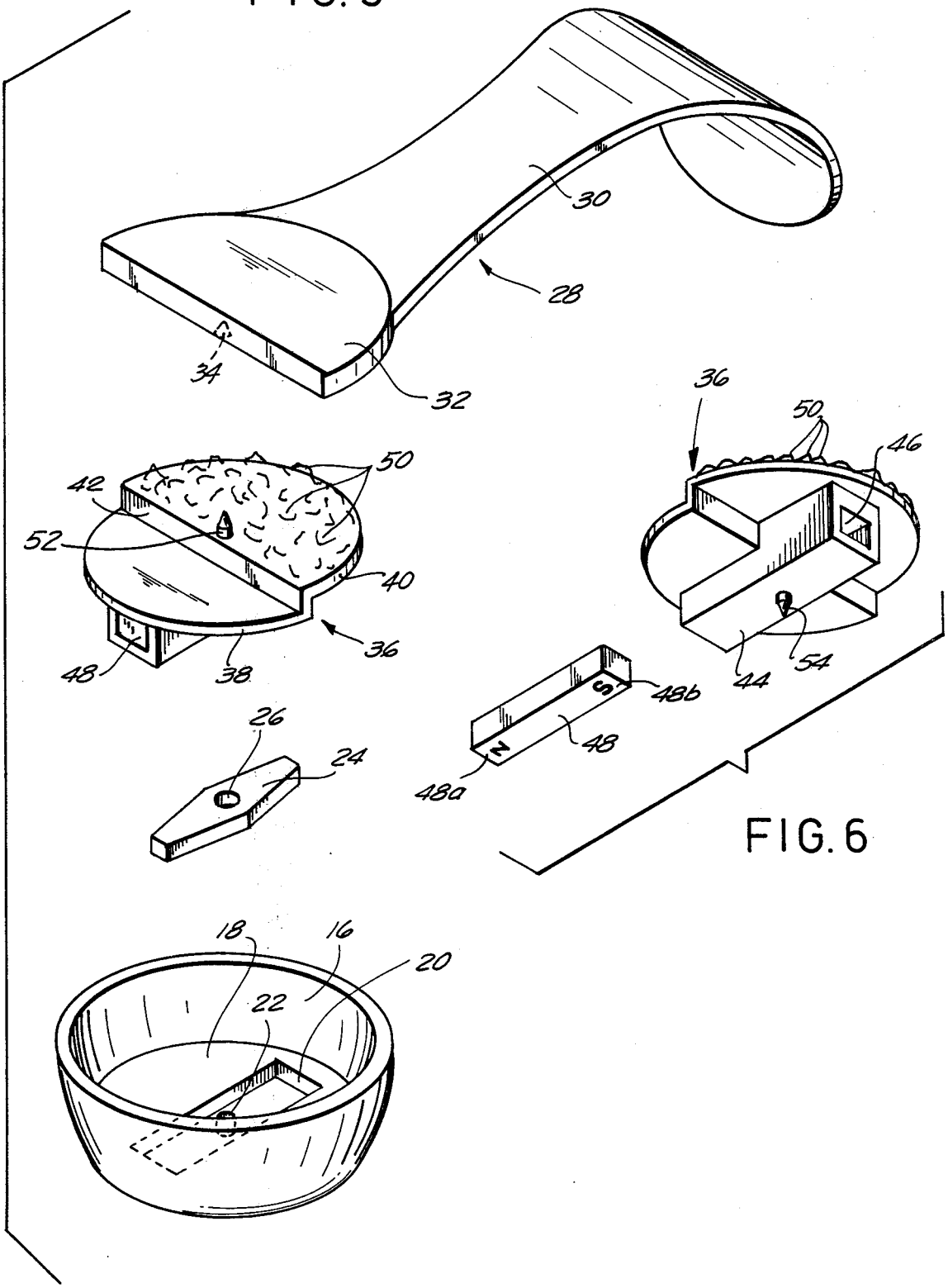
FIG. 5 is an exploded perspective view of the spoon of FIGS. 1–4, showing the various parts thereof.
FIG. 6 is an exploded view of the rotary disc of the spoon and the magnet which is mounted thereon, showing the lower side of said disc.

Referring in detail to the drawings, there is shown a toy feeding spoon 10 which operates in cooperation with the mouth of a baby doll 12 (FIG. 1), and with an imitation food container 14 (FIG. 3), to simulate the feeding of said doll with food taken from the container.

As best seen in FIG. 5, the spoon 10 comprises a hollow bowl portion 16 having a flat bottom wall 18 in which is formed an elongated rectangular depression 20. Centrally mounted within the rectangular depression 20 is an upstanding cylindrical bearing member 22. A flat metal bar 24 is also mounted within the rectangular depression 20 and is secured to the bottom wall thereof by a suitable adhesive. The bar 24 has a central aperture 26 through which the bearing member 22 extends.

The spoon 10 also comprises a handle portion 28 including an elongated handle 30 formed integrally at its forward end with a semi-circular cover member 32. The bottom surface of the cover member 32 is formed with a bearing socket 34 centered along the free edge thereof.

The spoon 10 also includes a rotatable insert 36 in the nature of a circular disc of a non-metallic material, such as a plastic, formed of two axially-offset substantially semi-circular portions 38 and 40. The disc portions 38 and 40 are joined by an upstanding wall 42 extending perpendicularly between both portions, in such a manner that the portion 38 is located on a plane located appreciably below the plane of the portion 40, as shown in FIG. 5.

An elongated rectangular housing 44 is formed integrally on the bottom surface of the disc-like insert 36, or may be formed separately and secured to the insert bottom surface by extending longitudinally therethrough as shown in FIGS. 5 and 6, the bore 46 being sized to receive and mount an elongated rectangular bar magnet 48 which is inserted therein during assembly of the spoon and secured in mounted position by a suitable adhesive or the like. As shown in FIG. 6, the housing 44 and its contained bar magnet 48 extend diametrically across the circular insert 36, with the ends of the magnet 48 projecting a short distance from the respective ends of the housing 44, as shown in FIGS. 1 and 3.

The insert disc 36 is made in the stepped form shown in FIG. 5 in order to create the illusion of the spoon 10 being filled with food and emptied successively during the simulated feeding of the doll. For this purpose, the upper surface of the lower disc portion 38 is flat and planar to serve as the false bottom of the spoon 10 in the empty condition thereof, as will be presently described. The upper surface of the elevated portion 40 is pebbled or formed with irregular projections as indicated by reference numeral 50, and is painted or otherwise colored to simulate baby food.

The insert portions 38 and 40 together define a circular disc. As shown in FIG. 5, the raised portion 40 may be a segment slightly greater than semi-circular, while the lower portion 38 may be a segment slightly less than semi-circular. A pointed pivot pin 52 is centrally mounted on the insert disc 36 adjacent the inner edge of the upper portion 40. As shown in FIG. 6, a similar pointed pivot pin 54 is centrally mounted beneath the insert disc 36, the pin 54 projecting from the outer wall of rectangular housing 44.

In assembling the spoon 10, the bar magnet 48 is inserted in the elongated housing 44 of the rotatable insert 36 and is permenently affixed therein. The bar magnet 48 has opposed ends **48*a* and 48*b* of opposite polarity. In the mounted position of the magnet 48 shown in FIG. 1, the north pole end 48*a* thereof is located proximate to the circumference of the lower disc portion 38, while the south pole end 48*b* is located proximate to the circumference of the raised disc portion 40**.

The metal bar 24 is inserted and secured within the rectangular depression 20 in the bottom wall 18 of bowl portion 16, with the cylindrical bearing member 22 extending through the aperture 26 in the bar 24. The rotatable insert 36 is inserted within the bowl portion 16 with the lower pivot pin 54 seating within said cylindrical bearing member 22 and being freely turnable therein. The handle portion 28 is now secured, as by a suitable adhesive, to the bowl portion 16 in the mounted position shown in FIG. 1 with the semi-circular cover member 32 overlying approximately half of the top open end of bowl portion 16, and the upper pivot pin 52 of insert 36 seated within the socket 34 and being freely rotatably therein.

The metal bar 24 is made of steel, or other material which is magnetically attractable. The magnet 48 in its mounted position is sufficiently close to the metal bar 24 that its poles **48*a* and 48*b* are attracted to the latter, so that the rectangular magnet 48 is normally maintained in a position in which it is aligned and in registry with the underlying metal bar 24 and is axially aligned with the spoon handle 30, as shown in FIGS. 2 and 4. By application of external magnets, in a manner to be presently described, the magnet 48, and the rotatable insert 36 in which it is mounted, may be turned through an angle of 180° so that either the north pole end 48*a* or the sourth pole end 48*b* may be located at the front end of the bowl portion 16, that is to say the end of the bowl remote from the handle portion 28. FIGS. 1 and 2 show a first position of the magnet 48 and insert 36 in which the north pole end 48*a* is located at the front of the spoon bowl portion 16, with the insert upper portion 40 located beneath the cover member 32 and concealed from view thereby. In this first position, the insert lower portion 38 is located in the open space forwardly of the cover member 32** so as to appear as the bottom of the spoon and create the impression that the spoon is empty.

FIGS. 3 and 4 show a second position of the magnet 48 and insert 36 in which the south pole end **48*b* of the magnet is located at the front of the spoon bowl portion 16. In this position, the insert lower portion 38 is located beneath the cover member 32 and is concealed thereby, while the insert upper portion 40 is located in the open space forwardly of the cover member 32** and is exposed to view. In this position, the spoon appears to be full of food.

FIG. 1 shows a portion of the head of a doll 12 with which the spoon 10 is to be used for simulated feeding. The head is formed with a partially-open mouth 56 within which, or adjacent to which a permanent magnet 58 is fixedly mounted. As shown in FIG. 1, magnet 58 is positioned with its south pole end **58*a*** facing the front surface of the doll face.

FIG. 3 shows the imitation food container 14 with which the spoon 10 is also intended to be used in the simulated feeding operation. The container 14 is preferably in the form of a glass jar of the type normally used as a container for baby food. The container 14 may be colored on the outside to simulate the appearance of food contained therein and is preferably opaque or covered by a label. Within the container 14 is secured a body of rigid material 60 which is shaped and colored to simulate soft baby food. The body 60 may be made of a suitable plastic molded to simulate a small quantity of baby food at the bottom of the container. Within the body 60 is embedded a permanent magnet 62 having opposite ends **62*a* and 62*b* of opposite polarity. The magnet 62 is mounted with its end 62*b* close to the upper surface of the body 60, and the end 62*b* should be of a polarity opposite to the polarity of the forward-facing end 58*a* of the magnet 58 located adjacent the doll mouth 56. In the embodiment illustrated, the upper end 62*b* of the magnet 62 is of north polarity, as shown in FIG. 3**.

In initiating performance of the feeding operation, it will be assumed that the spoon 10 is in its first position of FIG. 2 with the insert upper portion 40 concealed beneath the cover member 32 and the insert lower portion exposed to view forwardly of the cover member 32, so that the spoon bowl 16 appears to be empty. In this position the north pole end **48*a* of the magnet 48 is located at the forward end of the bowl portion 16, remote from the spoon handle 30. The user grasps the handle 30 and lowers the spoon 10 into the container 14 to the position shown in FIG. 3 in which the forward edge of the spool bowl 16 abuts the upper surface of the body 60 and the magnet 48 is in close proximity to the magnet 62. The forward, north pole 48*a* of the magnet 48 is repelled by the upper north pole 62*a* of the embedded magnet 62, causing the spoon insert 36 to rotate so that the opposite south pole 48*b* is turned forwardly and is attracted by the opposite, north pole 62*b* of embedded magnet 62. This brings the spoon 10 to its second position shown in FIG. 3** in which the upper insert portion 40 is exposed to view forwardly of the cover member 32, and the spoon bowl 16 appears to be full. In this phase of the feeding operation, therefore, it appears that an empty spoon is inserted in the food container and is withdrawn full of food.

When the spoon is withdrawn from the food container, it is brought to the mouth 56 of the doll 12 to the position shown in FIG. 1. In approaching this position, the south pole end 48*b* of the magnet 48 is brought into proximity with the south pole end 58*a* of the magnet 58 behind the doll mouth, causing these like poles to repel, so that the rotatable insert 36 is turned from its "filled" position of FIGS. 3 and 4 to its "empty" position of FIGS. 1 and 2. In this turning movement, the north pole end 48*a* of magnet 48 is attracted to the south pole end 58*a* of the fixed magnet 58, so that the lower portion 38 of the insert 36 is brought to an exposed position forwardly of the cover member 32, while the latter overlies and conceals the upper portion 40, so that the spoon bowl 16 appears to be empty. It therefore visually appears that a spoon filled with food is brought to the doll mouth 56 and is taken away empty, creating the illusion that the doll is fed with this spoonful of food. These steps are then repeated successively, the spoon being again lowered into the container 14 (to fill the spoon), and then brought to the doll mouth 56 (to empty the spoon).

When the rotatable insert 36 is turned between its position of FIGS. 1 and 2 and its position of FIGS. 3 and 4, the insert is maintained accurately in these positions by attraction of the magnet 48 to the metal bar 24 in the bottom wall of bowl 16. The attraction of the magnet 48 to the metal bar 24 is sufficiently strong to maintain the insert 36 in either of its "full" or "empty" positions and to prevent undesired turning of the insert during movement of the spoon. On the other hand the forces exerted between the poles of magnet 48 and the poles of the respective magnets 58 and 62 are stronger forces, sufficient to overcome the attraction of magnet 48 to the metal bar 24, so that the rotatable insert 36 is freely turned at the proper times.

While a preferred embodiment of the invention has been shown and described herein, it is obvious that numerous changes, omissions and additions may be made in such embodiment without departing from the spirit and scope of the invention.

What is claimed is:

1. Apparatus for simulating the feeding of food to a baby doll having a mouth portion, comprising a toy spoon including a hollow bowl having an open-top front end portion and a rear end portion, a handle projecting from the rear end portion of said bowl, a cover member covering over the rear end portion of said bowl, a circular disc rotatably mounted in said bowl portion and overlying the bottom wall thereof, said circular disc having a first half-section having a flat upper surface serving as a false bottom of said bowl, and a second, opposite half-section decorated to simulate food, said disc being turnable between a first operative position in which said first half section is in registry with and exposed at the front end portion of said bowl with said second half section in registry with the rear end portion of said bowl and concealed by said cover member, and a second operative position in which said second half section is in registry with and exposed at the front end portion of said bowl with said first half section in registry with the rear end portion of the bowl and concealed by said cover member, a bar magnet mounted on the under surface of said disc and extending diametrically from one edge portion of said disc to the opposite edge portion thereof, said magnet having at one end a first pole located beneath the first half section of said disc and at the other end a second opposite pole located beneath the second half section of said disc, and a permanent magnet fixedly mounted adjacent the mouth portion of the doll to be fed by said spoon, said permanent magnet being positioned with one of its poles facing and located proximate to the doll mouth opening, said one pole being of the same polarity as the second pole of said bar magnet, whereby when said spoon, in said second operative position with said second half section exposed to view, is brought into proximity with the mouth portion of said doll, the second pole of said bar magnet is repelled by said one pole of said permenent magnet to turn said disc to said first position in which its first half section is exposed to view.

2. Apparatus according to claim 1 in which said cover member is formed integrally with said handle.

3. Apparatus according to claim 1 in which the upper surface of the second half section of said disc is formed with an irregular upper surface colored to simulate a quantity of food.

4. Apparatus according to claim 3 in which said disc is of stepped configuration, the upper surface of said first half section being on a lower plane than the upper surface of said second half section, whereby in the first operative position of said disc said spoon appears to be empty and in said second operative position of said disc said spoon appears to be filled with food.

5. Apparatus according to claim 1 in which the hollow bowl portion of said spoon has a bottom wall formed with a recess, and an elongated metal bar seated within said recess and positioned to magnetically attract the poles of the bar magnet mounted on said disc for maintaining the disc in its operative positions against accidental movement therefrom.

6. Apparatus according to claim 1 which also includes a hollow container simulating a container of food, said container having a body of rigid material secured therein and a permanent magnet embedded in said body and having one pole thereof located proximate to the upper surface of said body, said one pole being of the same polarity as the first pole of the bar magnet mounted on said disc.

7. Apparatus according to claim 6 in which the upper surface of said body of rigid material is decorated identically to the upper surface of the second half section of said disc to simulate food, whereby when said spoon is inserted into said container with said disc in said first operative position, and brought to a position in which its bar magnet is located proximate to the permanent magnet in said container, said disc is turned from its first operative position to its second operative position to simulate an empty spoon being inserted into said container and a spoon containing food being withdrawn from said container.

* * * * *